US006482786B1

(12) United States Patent
Del Duca et al.

(10) Patent No.: US 6,482,786 B1
(45) Date of Patent: Nov. 19, 2002

(54) LIQUID BLEACHING COMPOSITIONS COMPRISING HYDROGEN PEROXIDE, BETAINE, AND ETHOXYLATED NONIONIC SURFACTANT

(75) Inventors: Valerio Del Duca, Massalubrense (IT); Stefano Giunti, Pesaro (IT); Nobuo Ishida, Osaka (JP)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/700,555

(22) PCT Filed: May 7, 1999

(86) PCT No.: PCT/IB99/00913

§ 371 (c)(1),
(2), (4) Date: Nov. 16, 2000

(87) PCT Pub. No.: WO99/63033

PCT Pub. Date: Dec. 9, 1999

(30) Foreign Application Priority Data

May 29, 1998 (EP) ..... 98870124

(51) Int. Cl.[7] ..... C11D 1/94; C11D 3/395

(52) U.S. Cl. ..... 510/309; 510/276; 510/286; 510/289; 510/291; 510/302; 510/356; 510/433; 510/421

(58) Field of Search ..... 510/276, 286, 510/289, 291, 302, 309, 356, 433, 421

(56) References Cited

U.S. PATENT DOCUMENTS

| | | | | |
|---|---|---|---|---|
| 4,298,492 A | | 11/1981 | Van den Brom | |
| 5,244,593 A | * | 9/1993 | Roselle et al. | 252/99 |
| 5,714,454 A | | 2/1998 | Thomas | |

FOREIGN PATENT DOCUMENTS

| | | | |
|---|---|---|---|
| EP | 351772 A2 | | 1/1990 |
| EP | 385216 A1 | | 9/1990 |
| EP | 404293 | * | 12/1990 |
| JP | 9100492 | | 4/1997 |
| WO | WO 95/07971 A1 | | 3/1995 |
| WO | WO 96/30484 A1 | | 10/1996 |
| WO | 97/25397 | * | 7/1997 |
| WO | WO 97/31092 A1 | | 8/1997 |

* cited by examiner

*Primary Examiner*—Charles Boyer
(74) *Attorney, Agent, or Firm*—James F. McBride; Kim W. Zerby; Steven E. Miller

(57) ABSTRACT

The present invention relates to a liquid bleaching composition comprising a peroxygen bleach, a zwitterionic betaine surfactant, a sulphonated hydrotrope, and a nonionic surfactant. This composition is suitable to deliver excellent stain removal performance and bleaching performance on various surfaces including fabrics and hard-surfaces, with improved physical stability, especially at low temperatures.

2 Claims, No Drawings

LIQUID BLEACHING COMPOSITIONS COMPRISING HYDROGEN PEROXIDE, BETAINE, AND ETHOXYLATED NONIONIC SURFACTANT

TECHNICAL FIELD

The present invention relates to liquid bleaching compositions with high phase stability at low temperatures. More particularly, the compositions herein are suitable for use on various surfaces including hard-surfaces and fabrics to provide stain removal and bleaching performance.

BACKGROUND

Liquid aqueous peroxygen bleach-containing compositions have been extensively described in the art, especially in laundry applications as laundry detergents, laundry additives or even laundry pretreaters.

For example, it is known that peroxygen bleach-containing compositions comprising nonionic surfactants in laundry applications show a good removal performance for encrustated stains/soils, which are otherwise particularly difficult to remove, such as grease, coffee, tea, grass, mud/clay-containing soils and the like. However, we have found that a drawback associated with such peroxygen bleach-containing compositions comprising nonionic surfactants is, that said compositions show a poor physical stability, especially at low temperatures, e.g., typically below +5° C. Indeed, the nonionic surfactants tend to separate from the aqueous phase and form a surfactant film on top of the peroxygen bleach-containing composition, this effect is accelerated at low temperatures and it is irreversible even when said composition gets back at ambient temperature.

It is thus an object of the present invention to formulate a peroxygen bleach-containing composition comprising a nonionic surfactant, said composition being physically stable upon prolonged periods of storage, especially at low temperatures.

It has now been found that improved physical stability, especially at low temperatures, i.e., typically below +5° C., can be achieved by adding a sulphonated hydrotrope and a zwitterionic betaine surfactant to a liquid peroxygen bleach-containing composition comprising at least a nonionic surfactant. Indeed, it is by adding these ingredients to said peroxygen bleach-containing composition that the tendency of the nonionic surfactants to separate from the aqueous phase and form a surfactant film on top of the peroxygen bleach-containing composition is reduced or even prevented. Additionally, the phase separation, occurring at low temperatures is reversible, i.e., it is possible to recuperate to a single phase solution when recovering from low temperatures.

In a preferred embodiment of the present invention, the zwitterionic betaine surfactants used herein are salt free. Indeed, it has been found that using a salt free zwitterionic betaine surfactant in the compositions according to the present invention reduces or even prevents the damage to fabrics and/or colors, which would otherwise occur, when fabrics are treated with liquid bleaching composition comprising a peroxygen bleach, especially when pretreating said fabrics, i.e., applying a composition in its neat form onto the fabrics for prolonged periods of time before rinsing said fabrics.

Advantageously, the present compositions also provide excellent stain removal performance on various stains including greasy stains and excellent bleaching performance. Indeed, it has been found that the compositions of the present invention, comprising a peroxygen bleach and as a surfactant system, a nonionic surfactant, preferably an ethoxylated nonionic surfactant, together with a zwitterionic betaine surfactant, preferably a salt free zwitterionic betaine surfactant, boost the removal of various types of stains including greasy stains like mayonnaise, vegetal oil, sebum, make-up, and more surprisingly boost the bleaching performance.

More particularly, the compositions of the present invention provide excellent stain removal performance on a broad range of stains and soils and excellent bleach performance when used in any laundry application, e.g., as a laundry detergent or a laundry additive, and especially when used as a laundry pretreater, or even in other household applications like in hard surface cleaning applications.

A further advantage is that the compositions herein are chemically stable upon prolonged periods of storage.

Yet another advantage of the compositions according to the present invention is that they are able to perform in a variety of conditions, i.e., in hard and soft water as well as when used neat or diluted.

BACKGROUND ART

EP-A-0 351 772 discloses stabilized hydrogen peroxide-containing compositions. However hydrogen peroxide-containing compositions comprising a nonionic surfactant, together with a betaine surfactant and a sulphonated hydrotrope are not exemplified.

U.S. Pat. No. 5,714,454 discloses liquid dishwashing compositions comprising a betaine surfactant, a nonionic surfactant and a solubilizing agent. However, no peroxygen bleach-containing compositions are disclosed.

WO 96/30484 discloses liquid alkaline detergent compositions comprising a mixture of nonionic and anionic surfactants, hydrogen peroxide, and a sulphonated hydrotrope. No betaine-containing compositions are disclosed.

WO 97/25397 discloses liquid dishwashing detergent compositions comprising a surfactant, a skin feel and rinsability enhancing system, and a protease enzyme. No peroxygen bleach-containing compositions are disclosed.

SUMMARY OF THE INVENTION

The present invention encompasses a liquid composition comprising a nonionic surfactant, a zwitterionic betaine surfactant, a sulphonated hydrotrope, and a peroxygen bleach.

The present invention further encompasses processes of treating a surface, e.g., a fabric or a hard-surface, starting from a liquid composition as defined herein. For example, the processes of treating fabrics include the steps of contacting said fabrics with the liquid composition herein neat or diluted, and subsequently rinsing said fabrics. In the preferred embodiment, when the fabrics are "pretreated", the composition is applied neat on the fabrics, and the fabrics are subsequently washed in a normal wash cycle.

DETAILED DESCRIPTION OF THE INVENTION

The Liquid Cleaning Composition

The compositions according to the present invention are liquid compositions as opposed to a solid or a gas. As used herein "liquid" includes "pasty" compositions. The liquid compositions herein are preferably aqueous compositions.

The liquid compositions according to the present invention preferably have a pH up to 9, more preferably from 2 to 7, and most preferably from 2 to 6. In a preferred embodiment the compositions according to the present invention are formulated in the neutral to the acidic pH range, which contributes to the chemical stability of the compositions and to the stain removal performance of the compositions. The pH of the compositions may be adjusted by any acidifying agents known to those skilled in the art. Examples of acidifying agents are organic acids such as citric acid and inorganic acids such as sulphuric acid.

Peroxygen Bleach

As a first essential element the compositions according to the present invention comprise a peroxygen bleach or a mixture thereof. Indeed, the presence of peroxygen bleach contributes to the excellent bleaching benefits of said compositions. Suitable peroxygen bleaches to be used herein are hydrogen peroxide, water soluble sources thereof, or mixtures thereof. As used herein a hydrogen peroxide source refers to any compound that produces perhydroxyl ions when said compound is in contact with water.

Suitable water-soluble sources of hydrogen peroxide for use herein include percarbonates, persilicates, persulphates such as monopersulfate, perborates, peroxyacids such as diperoxydodecandioic acid (DPDA), magnesium perphtalic acid, perlauric acid, perbenzoic and alkylperbenzoic acids, hydroperoxides, aliphatic and aromatic diacyl peroxides, and mixtures thereof. Preferred peroxygen bleaches herein are hydrogen peroxide, hydroperoxide and/or diacyl peroxide. Hydrogen peroxide is the most preferred peroxygen bleach herein.

Suitable hydroperoxides for use herein are tert-butyl hydroperoxide, cumyl hydroperoxide, 2,4,4-trimethylpentyl-2-hydroperoxide, di-isopropylbenzene-monohydroperoxide, tert-amyl hydroperoxide and 2,5-dimethyl-hexane-2,5-dihydroperoxide. Such hydroperoxides have the advantage to be particularly safe to fabrics and color while delivering excellent bleaching performance when used in any laundry application.

Suitable aliphatic diacyl peroxides for use herein are dilauroyl peroxide, didecanoyl peroxide, dimyristoyl peroxide, or mixtures thereof. Suitable aromatic diacyl peroxide for use herein is for example benzoyl peroxide. Such diacyl peroxides have the advantage to be particularly safe to fabrics and color while delivering excellent bleaching performance when used in any laundry application.

Typically, the compositions herein comprise from 0.01% to 20% by weight of the total composition of said peroxygen bleach or mixtures thereof, preferably from 1% to 15% and more preferably from 1.5% to 10%.

Nonionic Surfactant

As a second essential ingredient the compositions according to the present invention comprise a nonionic surfactant, or a mixture thereof.

Typically, the compositions according to the present invention comprise from 0.01% to 60% by weight of the total composition of a nonionic surfactant, or a mixture thereof, preferably from 0.1% to 25% and more preferably from 0.5% to 20%.

Particularly preferred nonionic surfactants are alkoxylated nonionic surfactants. Preferred alkoxylated nonionic surfactants herein are ethoxylated nonionic surfactants according to the formula $RO—(C_2H_4O)_nH$, wherein R is a $C_6$ to $C_{22}$ alkyl chain or a $C_6$ to $C_{28}$ alkyl benzene chain, and wherein n is from 0 to 20, preferably from 1 to 15 and, more preferably from 2 to 15 and most preferably from 2 to 12. The preferred R chains for use herein are the $C_8$ to $C_{22}$ alkyl chains. Propoxylated nonionic surfactants and ethoxy/propoxylated ones may also be used herein instead of the ethoxylated nonionic surfactants as defined herein above or together with said surfactants Preferred ethoxylated nonionic surfactants are according to the formula above and have an HLB (hydrophilic-lipophilic balance) below 16, preferably below 15, and more preferably below 14. Those ethoxylated nonionic surfactants have been found to provide good grease cutting properties.

Accordingly suitable ethoxylated nonionic surfactants for use herein are Dobanol® 91-2.5 (HLB=8.1; R is a mixture of C9 and $C_{11}$ alkyl chains, n is 2.5), or Lutensol® TO3 (HLB=8; R is a $C_{13}$ alkyl chains, n is 3), or Lutensol® AO3 (HLB=8; R is a mixture of $C_{13}$ and $C_{15}$ alkyl chains, n is 3), or Tergitol® 25L3 (HLB=7.7; R is in the range of $C_{12}$ to $C_{15}$ alkyl chain length, n is 3), or Dobanol® 23-3 (HLB=8.1; R is a mixture of $C_{12}$ and $C_{13}$ alkyl chains, n is 3), or Dobanol® 23-2 (HLB=6.2; R is a mixture of $C_{12}$ and $C_{13}$ alkyl chains, n is 2), or Dobanol® 45-7 (HLB=11.6; R is a mixture of $C_{14}$ and $C_{15}$ alkyl chains, n is 7) Dobanol® 23-6.5 (HLB=11.9; R is a mixture of $C_{12}$ and C13 alkyl chains, n is 6.5), or Dobanol® 25-7 (HLB=12; R is a mixture of $C_{12}$ and $C_{15}$ alkyl chains, n is 7), or Dobanol® 91-5 (HLB=11.6; R is a mixture of $C_9$ and $C_{11}$ alkyl chains, n is 5), or Dobanol® 91-6 (HLB=12.5; R is a mixture of $C_9$ and $C_{11}$ alkyl chains, n is 6), or Dobanol® 91-8 (HLB=13.7; R is a mixture of $C_9$ and $C_{11}$ alkyl chains, n is 8), Dobanol® 91-10 (HLB=14.2; R is a mixture of $C_9$ to $C_{11}$ alkyl chains, n is 10), Dobanol® 91-12 (HLB=14.5; R is a mixture of $C_9$ to $C_{11}$ alkyl chains, n is 12), or mixtures thereof. Preferred herein are Dobanol® 91-2.5 , or Lutensol® TO3, or Lutensol® AO3, or Tergitol® 25L3, or Dobanol® 23-3, or Dobanol® 23-2, or Dobanol® 45-7, Dobanol® 91-8, or Dobanol® 91-10, or Dobanol® 91-12, or mixtures thereof. These Dobanol$^R$ surfactants are commercially available from SHELL. These Lutensol® surfactants are commercially available from BASF and these Tergitol® surfactants are commercially available from UNION CARBIDE.

Suitable chemical processes for preparing the alkoxylated nonionic surfactants for use herein include condensation of corresponding alcohols with alkylene oxide, in the desired proportions. Such processes are well-known to the man skilled in the art and have been extensively described in the art.

The compositions herein may desirably comprise one of those ethoxylated nonionic surfactants or a mixture of those ethoxylated nonionic surfactants having different HLBs (hydrophilic-lipophilic balance). In a preferred embodiment the compositions herein comprise an ethoxylated nonionic surfactant according to the above formula and having an HLB up to 10 (i.e., a so called hydrophobic ethoxylated nonionic surfactant), preferably below 10, more preferably below 9, and an ethoxylated nonionic surfactant according to the above formula and having an HLB above 10 to 16 (i.e., a so called hydrophilic ethoxylated nonionic surfactant), preferably from 11 to 14. Indeed, in this preferred embodiment the compositions of the present invention typically comprise from 0.01% to 15% by weight of the total composition of said hydrophobic ethoxylated nonionic surfactant, preferably from 0.5% to 10% and from 0.01% to 15% by weight of said hydrophilic ethoxylated nonionic surfactant, preferably from 0.5% to 10%. Such mixtures of ethoxylated nonionic surfactants with different HLBs may be desired as they allow optimum grease cleaning removal performance on a broader range of greasy soils having different hydrophobic/hydrophilic characters.

Other suitable nonionic surfactants to be used herein include polyhydroxy fatty acid amide surfactants, or mixtures thereof, according to the formula:

$R^2—C(O)—N(R^1)—Z$, wherein $R^1$ is H, or $C_1$–$C_4$ alkyl, $C_1$–$C_4$ hydrocarbyl, 2-hydroxy ethyl, 2-hydroxy propyl or a mixture thereof, $R^2$ is $C_5$–$C_{31}$ hydrocarbyl, and Z is a polyhydroxyhydrocarbyl having a linear hydrocarbyl chain with at least 3 hydroxyls directly connected to the chain, or an alkoxylated derivative thereof.

Preferably, $R^1$ is $C_1$–$C_4$ alkyl, more preferably $C_1$ or $C_2$ alkyl and most preferably methyl, $R^2$ is a straight chain $C_7$–$C_{19}$ alkyl or alkenyl, preferably a straight chain $C_9$–$C_{18}$ alkyl or alkenyl, more preferably a straight chain $C_{11}$–$C_{18}$ alkyl or alkenyl, and most preferably a straight chain $C_{11}$–$C_{14}$ alkyl or alkenyl, or mixtures thereof. Z preferably will be derived from a reducing sugar in a reductive amination reaction; more preferably Z is a glycityl. Suitable reducing sugars include glucose, fructose, maltose, lactose, galactose, mannose and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2—(CHOR')(CHOH)—CH_2OH$, where n is an integer from 3 to 5, inclusive, and R' is H or a cyclic or aliphatic monosaccharide, and alkoxylated derivatives thereof. Most preferred are glycityls wherein n is 4, particularly $CH_2—(CHOH)_4—CH_2OH$.

In formula $R^2—C(O)—N(R^1)—Z$, $R^1$ can be, for example, N-methyl, N-ethyl, N-propyl, N-isopropyl, N-butyl, N-2-hydroxy ethyl, or N-2-hydroxy propyl. $R^2—C(O)—N<$ can be, for example, cocamide, stearamide, oleamide, lauramide, myristamide, capricamide, palmitamide, tallowamide and the like. Z can be 1-deoxyglucityl, 2-deoxyfructityl, 1-deoxymaltityl, 1-deoxylactityl, 1-deoxygalactityl, 1-deoxymannityl, 1-deoxymaltotriotityl and the like.

Suitable polyhydroxy fatty acid amide surfactants to be used herein may be commercially available under the trade name HOE® from Hoechst.

Methods for making polyhydroxy fatty acid amide surfactants are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed for example in GB patent specification 809,060, published Feb. 18, 1959, by Thomas Hedley & Co., Ltd., U.S. Pat. No. 2,965,576, issued Dec. 20, 1960 to E. R. Wilson, U.S. Pat. No. 2,703,798, Anthony M. Schwartz, issued Mar. 8, 1955, U.S. Pat. No. 1,985,424, issued Dec. 25, 1934 to Piggott and WO92/06070, each of which is incorporated herein by reference.

Zwitterionic Betaine Surfactant

As a third essential element the compositions according to the present invention comprise a zwitterionic betaine surfactant or a mixture thereof.

Typically, the compositions of the present invention comprise from 0.001% to 50% by weight of the total composition of a zwitterionic betaine surfactant, or a mixture thereof, preferably from 0.01% to 10% by weight, more preferably from 0.5% to 8% and most preferably from 0.5% to 5%.

Suitable zwitterionic betaine surfactants for use herein contain both a cationic hydrophilic group, i.e., a quaternary ammonium group, and anionic hydrophilic group on the same molecule at a relatively wide range of pH's. The typical anionic hydrophilic groups are carboxylates and sulphonates, although other groups like sulfates, phosphonates, and the like can be used. A generic formula for the zwitterionic betaine surfactant to be used herein is:

$R_1—N^+(R_2)(R_3)R_4X^-$ wherein $R_1$ is a hydrophobic group; $R_2$ is hydrogen, $C_1$–$C_6$ alkyl, hydroxy alkyl or other substituted $C_1$–$C_6$ alkyl group; $R_3$ is $C_1$–$C_6$ alkyl, hydroxy alkyl or other substituted $C_1$–$C_6$ alkyl group which can also be joined to $R_2$ to form ring structures with the N, or a $C_1$–$C_6$ sulphonate group; $R_4$ is a moiety joining the cationic nitrogen atom to the hydrophilic group and is typically an alkylene, hydroxy alkylene, or polyalkoxy group containing from 1 to 10 carbon atoms; and X is the hydrophilic group, which is a carboxylate or sulphonate group.

Preferred hydrophobic groups $R_1$ are aliphatic or aromatic, saturated or unsaturated, substituted or unsubstituted hydrocarbon chains that can contain linking groups such as amido groups, ester groups. More preferred $R_1$ is an alkyl group containing from 1 to 24 carbon atoms, preferably from 8 to 18, and more preferably from 10 to 16. These simple alkyl groups are preferred for cost and stability reasons. However, the hydrophobic group $R_1$ can also be an amido radical of the formula $R_a—C(O)—NH—(C(R_b)_2)_m$, wherein $R_a$ is an aliphatic or aromatic, saturated or unsaturated, substituted or unsubstituted hydrocarbon chain, preferably an alkyl group containing from 8 up to 20 carbon atoms, preferably up to 18, more preferably up to 16, $R_b$ is selected from the group consisting of hydrogen and hydroxy groups, and m is from 1 to 4, preferably from 2 to 3, more preferably 3, with no more than one hydroxy group in any $(C(R_b)_2)$ moiety.

Preferred $R_2$ is hydrogen, or a $C_1$–$C_3$ alkyl and more preferably methyl. Preferred $R_3$ is C1–C4 sulphonate group, or a $C_1$–$C_3$ alkyl and more preferably methyl. Preferred $R_4$ is $(CH2)_n$ wherein n is an integer from 1 to 10, preferably from 1 to 6, more preferably is from 1 to 3.

Some common examples of betaine/sulphobetaine are described in U.S. Pat. Nos. 2,082,275, 2,702,279 and 2,255,082, incorporated herein by reference.

Examples of particularly suitable alkyldimethyl betaines include coconut-dimethyl betaine, lauryl dimethyl betaine, decyl dimethyl betaine, 2-(N-decyl-N, N-dimethylammonia)acetate, 2-(N-coco N, N-dimethylammonio) acetate, myristyl dimethyl betaine, palmityl dimethyl betaine, cetyl dimethyl betaine, stearyl dimethyl betaine. For example Coconut dimethyl betaine is commercially available from Seppic under the trade name of Amonyl 265®. Lauryl betaine is commercially available from Albright & Wilson under the trade name Empigen BB/L®.

Examples of amidobetaines include cocoamidoethylbetaine, cocoamidopropyl betaine or C10–C14 fatty acylamidopropylene(hydropropylene) sulfobetaine. For example C10–C14 fatty acylamidopropylene(hydropropylene)sulfobetaine is commercially available from Sherex Company under the trade name "Varion CAS® sulfobetaine".

A further example of betaine is Lauryl-imminodipropionate commercially available from Rhone-Poulenc under the trade name Mirataine H2C-HA®.

In a preferred embodiment the zwitterionic betaine surfactants used herein are salt free. By "salt free zwitterionic betaine surfactants", it is meant herein that the zwifterionic betaine surfactant (raw material) herein contains less than 5% by weight of salts, preferably less than 3%, more preferably less than 2%, even more preferably less than 1% and most preferably from 0.01% to 0.5%.

By "salts" is in meant herein any material having as base unit, a couple made of positive ion (or positive molecular ion) and negative ion (or negative molecular ion) containing one or more halogen atoms. Such salts include sodium chloride, potassium chloride, sodium bromide and the like.

Such salts free zwitterionic betaine surfactants are obtainable by conventional manufacturing processes like inverse osmosis, electro-dyalises or fractionated precipitation. For example inverse osmosis is based on the principle of contacting the zwitterionic betaine surfactant raw material (commercially available ) with a polar solvent (it is to be understood that such a solvent is free of salts) separated by a semi-permeable membrane for example acetate-cellulose. An adequate pressure is applied on the system to allow the salts to migrate from the surfactant raw material to the polar solvent phase. This way the zwitterionic betaine surfactant raw material is purified, i.e., the salts is subtracted from the raw material.

Preferred salt free alkyldimethyl betaines include coconut-dimethyl betaine, lauryl dimethyl betaine, decyl dimethyl betaine, 2-(N-decyl-N, N-dimethyl-ammonia) acetate, 2-(N-coco N, N-dimethylammonio) acetate, myristyl dimethyl betaine, palmityl dimethyl betaine, cetyl dimethyl betaine, stearyl dimethyl betaine, all these salt free zwifterionic betaine surfactants contain less than 5% of salts.

Preferred salt free amidobetaines include cocoamidoethylbetaine, cocoamidopropyl betaine or C10–C14 fatty acylamidopropylene(hydropropylene) sulfobetaine, all these salt free zwitterionic betaine surfactants contain less than 5% of salts.

It has now been found that these salt free zwitterionic betaine surfactants reduce the tensile strength loss when used instead of conventional zwitterionic betaine surfactants in a liquid peroxygen bleach-containing composition to bleach fabrics.

It has further been found that these salt free zwitterionic betaine surfactants reduce color damage (i.e., color change and/or decoloration) when used instead of conventional zwitterionic betaine surfactants in a liquid peroxygen bleach-containing composition to bleach fabrics.

The reduced tensile strength loss and reduced color damage are observed even if the composition is left onto the soiled coloured fabrics upon prolonged periods of time before rinsing or washing then rinsing the fabrics, e.g. 24 hours. Actually, the presence of these salt free zwitterionic betaine surfactants in a peroxygen bleach-containing composition prevents the decomposition (oxidation) of dyes generally present on the surface of coloured fabrics such as bleach sensitive dyes and/or metallized dyes including copper-formazan dyes and/or metal-azo dyes.

It is speculated that the presence of salts in the zwitterionic betaine surfactants, i.e., the halides like Cl—, Br— and the like, catalyses the radical decomposition of peroxygen bleaches like hydrogen peroxide and oxidation. Thus, it is believed that a radical reaction occurs on the surface of the fabrics with generation of free radicals, which results in loss of tensile strength and/or colour damage. Using the salts free zwitterionic betaine surfactants reduces the radical and oxidative decomposition of the peroxygen bleach, and thus results in reduced tensile strength loss and reduced colour damage.

The tensile strength in a fabric may be measured by stretching said fabric until it breaks. The force needed to break the fabric is the "Ultimate Tensile Stress" and may be measured with a stress-strain INSTRON® machine available from INSTRON. The loss of tensile strength is the difference between the tensile strength of a fabric taken as a reference, e.g. a fabric which has not been bleached, and the tensile strength of the same fabric after having been bleached with a composition of the present invention. A tensile strength loss of zero means that no fabric damage is observed.

The colour safety can be evaluated visually by comparing side by side fabrics pretreated with a composition of the present invention and the reference composition. Differences and graduations in colour can be visually assessed and ranked according to Panel Score Units (PSU) using any suitable scale. PSU data can be handled statistically using conventional techniques. Alternatively, various types of optical apparatus and procedures can be used to assess the improvement in colour safety afforded by the present invention. For example when evaluating colour safety on fabrics measurements with Hunterlab colour Quest 45/0 apparatus can be used.

The combination of zwitterionic betaine surfactants, preferably salt free zwitterionic betaine surfactants, and nonionic surfactants, preferably ethoxylated nonionic surfactants, herein provide excellent stain removal performance on greasy stains, while providing excellent bleaching performance to the liquid peroxygen bleach-containing compositions of the present invention comprising them.

Indeed, a significant cooperation has been observed between these ingredients to get optimum stain removal performance on a variety of soils, from particulate to non-particulate soils from hydrophobic to hydrophilic soils under any household application and especially laundry application on both hydrophilic and hydrophobic fabrics.

More particularly, the use of zwitterionic betaine surfactants, preferably salt free zwitterionic betaine surfactants, on top of nonionic surfactants, preferably ethoxylated nonionic surfactants, in a liquid aqueous composition comprising a peroxygen bleach, boosts the bleaching performance and the removal of various types of stains including greasy stains (e.g., lipstick, olive oil, mayonnaise, vegetal oil, sebum, make-up), as compared to the bleaching and stain removal performance delivered by the same composition based only on one of these ingredients (i.e., nonionic surfactant or zwitterionic betaine surfactant).

The stain removal performance may be evaluated by the following test methods on various types of stains.

A suitable test method for evaluating the stain removal performance on a soiled fabric for example under pretreatment condition is the following: A composition according to the present invention is applied neat to a fabric preferably to the soiled portion of the fabric, left to act from 1 to 10 minutes, and said pretreated fabric is then washed according to common washing conditions, at a temperature of from 30° to 70° C. for from 10 to 100 minutes. The stain removal is then evaluated by comparing side by side the soiled fabric pretreated with the composition of the present invention with those pretreated with the reference, e.g., the same composition but comprising only a nonionic surfactant or only a zwitterionic betaine surfactant as the sole surfactant. A visual grading may be used to assign difference in panel units (psu) in a range from 0 to 4.

The bleaching performance may be evaluated as for the stain removal performance but the stains used are bleachable stains like coffee, tea and the like.

Sulphonated Hydrotrope

As a fourth essential ingredient the compositions according to the present invention comprise a sulphonated hydrotrope or a mixture thereof.

Any sulphonated hydrotropes known to those skilled in the art are suitable for use herein. In a preferred embodiment alkyl aryl sulphonates or alkyl aryl sulphonic acids are used. Preferred alkyl aryl sulphonates include sodium, potassium, calcium and ammonium xylene sulphonates, sodium, potassium, calcium and ammonium toluene sulphonates, sodium, potassium, calcium and ammonium cumene sulphonates, sodium, potassium, calcium and ammonium substituted or unsubstituted naphthalene sulphonates and mixtures thereof. Preferred alkyl aryl sulphonic acids include xylenesulphonic acid, toluenesulphonic acid, cumenesulphonic acid, substituted or unsubstituted naphthalenesulphonic acid and mixtures thereof. More preferably, xylenesulphonic acid or p-toluene sulphonate or mixtures thereof are used.

Typically, the compositions herein comprise from 0.01% to 20% by weight of the total composition of a sulphonated hydrotrope, or a mixture thereof, preferably from 0.05% to 10% and more preferably from 0.1% to 5%.

In an aqueous solution, nonionic surfactants, like ethoxylated nonionic surfactants, tend to separate from water and make a surfactant film on top of the solution. This phenomena is majorly accelerated at low temperatures, i.e., typically below 5° C., and it is irreversible when the solution gets back at ambient temperature. The advantage of this development is to increase the physical stability, i.e., the phase stability, by adding a zwitterionic surfactant that assures full solubility and a sulphonated hydrotrope that allows to recuperate the isotropy when recovering from very low temperatures.

By "physically stable", it is meant herein that no phase separation occurs in the compositions for a period of 1 month at 0° C.

Physical stability at low temperature upon prolonged time periods of storage of the compositions herein may be evaluated by the following visual grading test method. Of the compositions to be tested, 100 ml samples are prepared in transparent plastic container (at least 3 replicates). The samples are put at the appropriate temperature, using a climatic chamber and checked after several time periods, e.g., 1, 2, 3, 7, 15 and 30 days, and evaluated according to a visual grading system.

For optimal physical stability it has been found that the composition according to the present invention has a weight ratio of zwitterionic betaine surfactant to sulphonated hydrotrope from 0.1:1 to 100:1, more preferably from 1:1 to 10:1, more preferably from 2:1 to 5:1, and most preferably of 3:1.

An advantage of the liquid compositions of the present invention is that they are chemically stable upon prolonged periods of storage.

Chemical stability of the compositions herein may be evaluated by measuring the concentration of available oxygen (often abbreviated to AvO2) at given storage time after having manufactured the compositions. The concentration of available oxygen can be measured by chemical titration methods known in the art, such as the iodometric method, thiosulphatimetric method, the permanganometric method and the cerimetric method. Said methods and the criteria for the choice of the appropriate method are described for example in "Hydrogen Peroxide", W. C. Schumb, C. N. Satterfield and R. L. Wentworth, Reinhold Publishing Corporation, New York, 1955 and "Organic Peroxides", Daniel Swern, Editor Wiley Int. Science, 1970.

Optional Ingredients

The compositions herein may further comprise a variety of other optional ingredients such as chelating agents, builders, other surfactants, stabilisers, bleach activators, soil suspenders, soil suspending polyamine polymers, polymeric soil release agents, foam reducing systems, radical scavengers, catalysts, dye transfer agents, solvents, brighteners, perfumes, pigments and dyes.

Surfactants

The compositions of the present invention may further comprise other surfactants than the ones mentioned herein before including anionic surfactants, cationic surfactants and/or amphoteric surfactants.

Typically, the compositions according to the present invention may comprise from 0.01% to 30% by weight of the total composition of another surfactant on top of the zwitterionic betaine surfactant and the nonionic surfactant, preferably from 0.1% to 25% and more preferably from 0.5% to 20%.

Suitable anionic surfactants to be used in the compositions herein include water-soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like). Typically, alkyl chains of $C_{12-16}$ are preferred for lower wash temperatures (e.g., below about 50° C.) and $C_{16-18}$ alkyl chains are preferred for higher wash temperatures (e.g., above about 50° C.).

Other suitable anionic surfactants for use herein are water-soluble salts or acids of the formula $RO(A)_mSO_3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethylammonium and quaternary ammonium cations, such as tetramethyl-ammonium, dimethyl piperdinium and cations derived from alkanolamines such as ethylamine, diethylamine, triethylamine, mixtures thereof, and the like. Exemplary surfactants are $C_{12}$–$C_{18}$ alkyl polyethoxylate (1.0) sulfate, $C_{12}$–$C_{18}E(1.0)M$), $C_{12}$–$C_{18}$ alkyl polyethoxylate (2.25) sulfate, $C_{12}$–$C_{18}E(2.25)M$), $C_{12}$–$C_{18}$ alkyl polyethoxylate (3.0) sulfate $C_{12}$–$C_{18}E(3.0)$, and $C_{12}$–$C_{18}$ alkyl polyethoxylate (4.0) sulfate $C_{12}$–$C_{18}E(4.0)M$), wherein M is conveniently selected from sodium and potassium.

Other anionic surfactants useful for detersive purposes can also be used herein. These can include salts (including, for example, sodium, potassium, ammonium, and substituted ammonium salts such as mono-, di- and triethanolamine salts) of soap, $C_9$–$C_{20}$ linear alkylbenzenesulphonates, $C_8$–$C_{22}$ primary or secondary alkanesulphonates, $C_8$–$C_{24}$ olefinsulphonates, sulphonated polycarboxylic acids prepared by sulphonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl ester sulphonates such as $C_{14-16}$ methyl ester sulphonates; acyl glycerol sulphonates, fatty oleyl glycerol sulfates, alkyl phenol ethylene oxide ether sulfates, paraffin sulphonates, alkyl phosphates, isethionates such as the acyl isethionates, N-acyl taurates, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_kCH_2COO\text{-}M^{30}$ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975, to Laughlin, et al. at Column 23, line 58 through Column 29, line 23 (herein incorporated by reference).

Other suitable anionic surfactants to be used herein also include acyl sarcosinate or mixtures thereof, in its acid and/or salt form, preferably long chain acyl sarcosinates having the following formula:

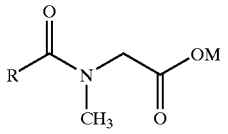

wherein M is hydrogen or a cationic moiety and wherein R is an alkyl group of from 11 to 15 carbon atoms, preferably of from 11 to 13 carbon atoms. Preferred M are hydrogen and alkali metal salts, especially sodium and potassium. Said acyl sarcosinate surfactants are derived from natural fatty acids and the amino-acid sarcosine (N-methyl glycine). They are suitable to be used as aqueous solution of their salt or in their acidic form as powder. Being derivatives of natural fatty acids, said acyl sarcosinates are rapidly and completely biodegradable and have good skin compatibility.

Accordingly, suitable long chain acyl sarcosinates to be used herein include $C_{12}$ acyl sarcosinate (i.e., an acyl sarcosinate according to the above formula wherein M is hydrogen and R is an alkyl group of 11 carbon atoms) and $C_{14}$ acyl sarcosinate (i.e., an acyl sarcosinate according to the above formula wherein M is hydrogen and R is an alkyl group of 13 carbon atoms). $C_{12}$ acyl sarcosinate is commercially available, for example, as Hamposyl L-30® supplied by Hampshire. $C_{14}$ acyl sarcosinate is commercially available, for example, as Hamposyl M-30® supplied by Hampshire.

Suitable amphoteric surfactants to be used herein include amine oxides having the following formula $R_1R_2R_3NO$ wherein each of R1, R2 and R3 is independently a saturated substituted or unsubstituted, linear or branched hydrocarbon chains of from 1 to 30 carbon atoms. Preferred amine oxide surfactants to be used according to the present invention are amine oxides having the following formula $R_1R_2R_3NO$ wherein R1 is an hydrocarbon chain comprising from 1 to 30 carbon atoms, preferably from 6 to 20, more preferably from 8 to 16, most preferably from 8 to 12, and wherein R2 and R3 are independently substituted or unsubstituted, linear or branched hydrocarbon chains comprising from 1 to 4 carbon atoms, preferably from 1 to 3 carbon atoms, and more preferably are methyl groups. R1 may be a saturated substituted or unsubstituted linear or branched hydrocarbon chain. Suitable amine oxides for use herein are for instance natural blend C8–C10 amine oxides as well as C12–C16 amine oxides commercially available from Hoechst.

Chelating Agents

The compositions of the present invention may comprise a chelating agent or a mixture thereof as a preferred optional ingredient. Suitable chelating agents may be any of those known to those skilled in the art such as the ones selected from the group comprising phosphonate chelating agents, amino carboxylate chelating agents, other carboxylate chelating agents, polyfunctionally-substituted aromatic chelating agents, ethylenediamine N,N'-disuccinic acids, or mixtures thereof. A chelating agent may be desired in the compositions of the present invention as it allows to increase the ionic strength of the compositions herein and thus their stain removal and bleaching performance on various surfaces. The presence of chelating agents may also contribute to reduce the tensile strength loss of fabrics and/or color damage, especially in a laundry pretreatment application. Indeed, the chelating agents inactivate the metal ions present on the surface of the fabrics and/or in the cleaning compositions (neat or diluted) that otherwise would contribute to the radical decomposition of the peroxygen bleach.

Suitable phosphonate chelating agents to be used herein may include alkali metal ethane 1-hydroxy diphosphonates (HEDP) also known as ethydronic acid, alkylene poly (alkylene phosphonate), as well as amino phosphonate compounds, including amino aminotri(methylene phosphonic acid) (ATMP), nitrilo trimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelating agents to be used herein are diethylene triamine penta methylene phosphonate (DTPMP) and ethane 1-hydroxy diphosphonate (HEDP or ethydronic acid). Such phosphonate chelating agents are commercially available from Monsanto under the trade name DEQUEST®.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy -3,5-disulfobenzene.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer have been extensively described in U.S. Pat. No. 4,704,233, Nov. 3, 1987, to Hartman and Perkins. Ethylenediamine N,N'-disuccinic acids is, for instance, commercially available under the tradename ssEDDS® from Palmer Research Laboratories.

Suitable amino carboxylates to be used herein include ethylene diamine tetra acetates, diethylene triamine pentaacetates, diethylene triamine pentaacetate (DTPA),N-hydroxyethylethylenediamine triacetates, nitrilotri-acetates, ethylenediamine tetrapropionates, triethylenetetraaminehexa-acetates, ethanol-diglycines, propylene diamine tetracetic acid (PDTA) and methyl glycine di-acetic acid (MGDA), both in their acid form, or in their alkali metal, ammonium, and substituted ammonium salt forms. Particularly suitable amino carboxylates to be used herein are diethylene triamine penta acetic acid, propylene diamine tetracetic acid (PDTA) which is, for instance, commercially available from BASF under the trade name Trilon FS® and methyl glycine di-acetic acid (MGDA).

Further carboxylate chelating agents to be used herein include salicylic acid, aspartic acid, glutamic acid, glycine, malonic acid or mixtures thereof.

Another chelating agent for use herein is of the formula:

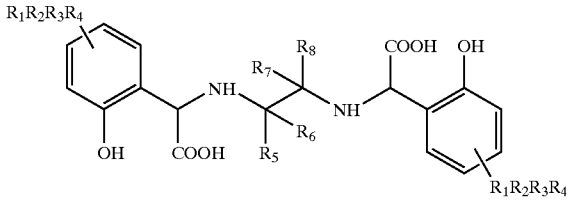

wherein $R_1$, $R_2$, $R_3$, and $R_4$ are independently selected from the group consisting of —H, alkyl, alkoxy, aryl, aryloxy, —Cl, —Br, —$NO_2$, —C(O)R', and —$SO_2$R"; wherein R' is selected from the group consisting of —H, —OH, alkyl, alkoxy, aryl, and aryloxy; R" is selected from the group consisting of alkyl, alkoxy, aryl, and aryloxy; and $R_5$, $R_6$, $R_7$, and $R_8$ are independently selected from the group consisting of —H and alkyl.

Particularly preferred chelating agents to be used herein are amino aminotri(methylene phosphonic acid), di-ethylene-triamino-pentaacetic acid, diethylene triamine penta methylene phosphonate, 1-hydroxy ethane diphosphonate, ethylenediamine N,N'-disuccinic acid, and mixtures thereof.

Typically, the compositions according to the present invention comprise up to 5% by weight of the total composition of a chelating agent, or mixtures thereof, preferably from 0.01% to 1.5% by weight and more preferably from 0.01% to 0.5%.

Foam Reducing System

The compositions according to the present invention may further comprise a foam reducing agent or a mixture thereof. Any foam reducing agents known to those skilled in the art are suitable for use herein. In a preferred embodiment a foam reducing system comprising a fatty acid together with a capped alkoxylated nonionic surfactant as defined herein after and/or silicone is used.

Typically, the compositions herein may comprise from $1\cdot10^{-4}$% to 10% by weight of the total composition of a fatty acid or a mixture thereof, preferably from $1\cdot10^{-3}$% to 5% and more preferably from $1\cdot10^{-2}$% to 5%.

Typically, the compositions herein may comprise from $1\cdot10^{-3}$% to 20% by weight of the total composition of a capped alkoxylated nonionic surfactant as defined herein or a mixture thereof, preferably from $1\cdot10^{-2}$% to 10% and more preferably from $5\cdot10^{-2}$% to 5%.

Typically, the compositions herein may comprise from $1\cdot10^{-5}$% to 5% by weight of the total composition of a silicone or a mixture thereof, preferably from $1\cdot10^{-5}$% to 1% and more preferably from $1\cdot10^{-4}$% to 0.5%.

Suitable fatty acids for use herein are the alkali salts of a $C_8$–$C_{24}$ fatty acid. Such alkali salts include the metal fully saturated salts like sodium, potassium and/or lithium salts as well as the ammonium and/or alkylammonium salts of fatty acids, preferably the sodium salt. Preferred fatty acids for use herein contain from 8 to 22 carbon atoms, preferably from 8 to 20 and more preferably from 8 to 18.

Suitable fatty acids may be selected from caprylic acid, capric acid, lauric acid, myristic acid, palmitic acid, stearic acid, and mixtures of fatty acids suitably hardened, derived from natural sources such as plant or animal esters (e.g., palm oil, coconut oil, soybean oil, castor oil, tallow, ground oil, whale and fish oils and/or babassu oil.

For example Coconut Fatty Acid is commercially available from UNICHEMA under the name PRIFAC 5900®.

Suitable capped alkoxylated nonionic surfactants for use herein are according to the formula:

$$R_1(O—CH_2—CH_2)_n—(OR_2)_m—O—R_3$$

wherein $R_1$ is a $C_8$–$C_{24}$ linear or branched alkyl or alkenyl group, aryl group, alkaryl group, preferably $R_1$ is a $C_8$–$C_1$ alkyl or alkenyl group, more preferably a $C_{10}$–$C_{15}$ alkyl or alkenyl group, even more preferably a $C_{10}$–$C_{15}$ alkyl group;

wherein $R_2$ is a $C_1$–$C_{10}$ linear or branched alkyl group, preferably a $C_2$–$C_{10}$ linear or branched alkyl group, preferably a $C_3$ group;

wherein $R_3$ is a $C_1$–$C_{10}$ alkyl or alkenyl group, preferably a $C_1$–$C_5$ alkyl group, more preferably methyl;

and wherein n and m are integers independently ranging in the range of from 1 to 20, preferably from 1 to 10, more preferably from 1 to 5; or mixtures thereof.

These surfactants are commercially available from BASF under the trade name Plurafac®, from HOECHST under the trade name Genapol® or from ICI under the trade name Symperonic®. Preferred capped nonionic alkoxylated surfactants of the above formula are those commercially available under the tradename Genapol® L 2.5 NR from Hoechst, and Plurafac® from BASF.

Suitable silicones for use herein include any silicone and silica-silicone mixtures. Silicones can be generally represented by alkylated polysiloxane materials while silica is normally used in finely divided forms exemplified by silica aerogels and xerogels and hydrophobic silicas of various types. These materials can be incorporated as particulates in which the silicone is advantageously releasably incorporated in a water-soluble or water-dispersible, substantially non-surface-active detergent impermeable carrier. Alternatively, the silicone can be dissolved or dispersed in a liquid carrier and applied by spraying on to one or more of the other components.

Actually in industrial practice, the term "silicone" has become a generic term which encompasses a variety of relatively high-molecular-weight polymers containing siloxane units and hydrocarbyl groups of various types. Indeed, silicone compounds have been extensively described in the art, see for instance U.S. Pat Nos. 4,076,648, 4,021,365, 4,749,40, 4,983,316, EP 150 872, EP 217 501 and EP 499 364. The silicone compounds disclosed therein are suitable in the context of the present invention. Generally, the silicone compounds can be described as siloxanes having the general structure:

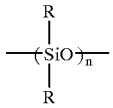

wherein n is from 20 to 2000, and where each R independently can be an alkyl or an aryl radical. Examples of such substituents are methyl, ethyl, propyl, isobutyl, and phenyl. Preferred polydiorganosiloxanes are polydimethylsiloxanes having trimethylsilyl end blocking units and having a viscosity at 25° C. of from $5\times10^{-5}$ $m^2/s$ to 0.1 $m^2/s$, i.e. a value of n in the range 40 to 1500. These are preferred because of their ready availability and their relatively low cost.

A preferred type of silicone compounds useful in the compositions herein comprises a mixture of an alkylated siloxane of the type herein above disclosed and solid silica.

The solid silica can be a fumed silica, a precipitated silica or a silica made by the gel formation technique. The silica particles can be rendered hydrophobic by treating them with diakylsilyl groups and/or trialkylsilane groups either bonded directly onto the silica or by means of silicone resin. A preferred silicone compound comprises a hydrophobic silanated, most preferably trimethylsilanated silica having a particle size in the range from 10 mm to 20 mm and a specific surface area above 50 $m^2/g$. Silicone compounds employed in the compositions according to the present invention suitably have an amount of silica in the range of 1 to 30% (more preferably 2.0 to 15%) by weight of the total weight of the silicone compounds resulting in silicone compounds having an average viscosity in the range of from $2\times10^{-4}$ $m^2/s$ to 1 $m^2/s$. Preferred silicone compounds may have a viscosity in the range of from $5\times10^{-3}$ $m^2/s$ to 0.1 $m^2/s$. Particularly suitable are silicone compounds with a viscosity of $2\times10^{-2}$ $m^2/s$ or $4.5\times10^{-2}$ $m^2/s$.

Suitable silicone compounds for use herein are commercially available from various companies including Rhone Poulenc, Fueller and Dow Corning. Examples of silicone compounds for use herein are Silicone DB® 100 and Silicone Emulsion 2-3597® both commercially available from Dow Corning.

Another silicone compound is disclosed in Bartollota et al. U.S. Pat. No. 3,933, 672. Other particularly useful silicone compounds are the self-emulsifying silicone compounds, described in German Patent Application DTOS 2 646 126 published Apr. 28, 1977. An example of such a compound is DC-544®, commercially available from Dow Corning, which is a siloxane-glycol copolymer.

Typically preferred silicone compounds are described in European Patent application EP-A-573699. Said compositions can comprise a silicone/silica mixture in combination with fumed nonporous silica such as Aerosil®.

Other suitable foam reducing agents to be used herein include 2-alkyl alkanol, or mixtures thereof, having an alkyl chain comprising from 6 to 16 carbon atoms, preferably from 8 to 12 and a terminal hydroxy group, said alkyl chain being substituted in the $\alpha$ position by an alkyl chain comprising from 1 to 10 carbon atoms, preferably from 2 to 8 and more preferably 3 to 6. Such suitable compounds are commercially available, for instance, in the Isofol® series such as Isofol® 12 (2-butyl octanol) or Isofol® 16 (2-hexyl decanol). Typically, the compositions herein may comprise from 0.05% to 2% by weight of the total composition of a 2-alkyl alkanol, or mixtures thereof, preferably from 0.1% to 1.5% and most preferably from 0.1% to 0.8%.

Radical Scavenger

The compositions of the present invention may comprise a radical scavenger or a mixture thereof. Suitable radical scavengers for use herein include the well-known substituted mono and dihydroxy benzenes and their analogs, alkyl and aryl carboxylates and mixtures thereof. Preferred such radical scavengers for use herein include di-tert-butyl hydroxy toluene (BHT), hydroquinone, di-tert-butyl hydroquinone, mono-tert-butyl hydroquinone, tert-butyl-hydroxy anysole, benzoic acid, toluic acid, catechol, t-butyl catechol, benzylamine, 1,1,3-tris(2-methyl-4-hydroxy-5-t-butylphenyl) butane, n-propyl-gallate or mixtures thereof and highly preferred is di-tert-butyl hydroxy toluene. Such radical scavengers like N-propyl-gallate may be commercially available from Nipa Laboratories under the trade name Nipanox S1®. Radical scavengers when used, are typically present herein in amounts ranging from up to 10% by weight of the total composition and preferably from 0.001% to 0.5% by weight.

The presence of radical scavengers may contribute to reduce tensile strength loss of fabrics and/or color damage when the compositions of the present invention are used in any laundry application, especially in a laundry pretreatment application.

Antioxidant

The compositions according to the present invention may further comprise an antioxidant or mixtures thereof. Typically, the compositions herein comprise up to 10% by weight of the total composition of an antioxidant or mixtures thereof, preferably from 0.002% to 5%, more preferably from 0.005% to 2%, and most preferably from 0.01% to 1%.

Suitable antioxidants to be used herein include organic acids like citric acid, ascorbic acid, tartaric acid, adipic acid and sorbic acid, or amines like lecithin, or aminoacids like glutamine, methionine and cysteine, or esters like ascorbil paimitate, ascorbil stearate and triethylcitrate, or mixtures thereof. Preferred antioxidants for use herein are citric acid, ascorbic acid, ascorbil palmitate, lecithin or mixtures thereof.

Bleach Activator

As an optional ingredient, the compositions of the present invention may comprise a bleach activator or mixtures thereof. By "bleach activator", it is meant herein a compound which reacts with hydrogen peroxide to form a peracid. The peracid thus formed constitutes the activated bleach. Suitable bleach activators to be used herein include those belonging to the class of esters, amides, imides, or anhydrides. Examples of suitable compounds of this type are disclosed in British Patent GB 1 586 769 and GB 2 143 231 and a method for their formation into a prilled form is described in European Published Patent Application EP-A-62 523. Suitable examples of such compounds to be used herein are tetracetyl ethylene diamine (TAED), sodium 3,5,5 trimethyl hexanoyloxybenzene sulphonate, diperoxy dodecanoic acid as described for instance in U.S. Pat. No. 4,818,425 and nonylamide of peroxyadipic acid as described for instance in U.S. Pat No. 4,259,201 and n-nonanoyloxybenzenesulphonate (NOBS). Also suitable are N-acyl caprolactams selected from the group consisting of substituted or unsubstituted benzoyl caprolactam, octanoyl caprolactam, nonanoyl caprolactam, hexanoyl caprolactam, decanoyl caprolactam, undecenoyl caprolactam, formyl caprolactam, acetyl caprolactam, propanoyl caprolactam, butanoyl caprolactam pentanoyl caprolactam or mixtures thereof. A particular family of bleach activators of interest was disclosed in EP 624 154, and particularly preferred in that family is acetyl triethyl citrate (ATC). Acetyl triethyl citrate has the advantage that it is environmental-friendly as it eventually degrades into citric acid and alcohol. Furthermore, acetyl triethyl citrate has a good hydrolytical stability in the product upon storage and it is an efficient bleach activator. Finally, it provides good building capacity to the composition. The compositions according to the present invention may comprise from 0.01% to 20% by weight of the total composition of said bleach activator, or mixtures thereof, preferably from 1% to 10%, and more preferably from 3% to 7%.

Treating Processes

In the present invention, the liquid aqueous composition of the present invention needs to be contacted with the surface to treat.

By "surfaces" it is meant herein any inanimate surface. These inanimate surfaces include, but are not limited to, hard-surfaces typically found in houses like kitchens, bathrooms, or in car interiors, e.g., tiles, walls, floors, chrome, glass, smooth vinyl, any plastic, plastified wood, table top, sinks, cooker tops, dishes, sanitary fittings such as sinks, showers, shower curtains, wash basins, WCs and the like, as well as fabrics including clothes, curtains, drapes, bed linens, bath linens, table cloths, sleeping bags, tents, upholstered furniture and the like, and carpets. Inanimate surfaces also include household appliances including, but not limited to, refrigerators, freezers, washing machines, automatic dryers, ovens, microwave ovens, dishwashers and so on.

Thus, the present invention also encompasses a process of treating a fabric, as the inanimate surface. In such a process a composition, as defined herein, is contacted with the fabrics to be treated. This can be done either in a so-called "pretreatment mode", where a composition, as defined herein, is applied neat onto said fabrics before the fabrics are rinsed, or washed then rinsed, or in a "soaking mode" where a composition, as defined herein, is first diluted in an aqueous bath and the fabrics are immersed and soaked in the bath, before they are rinsed, or in a "through the wash mode", where a composition, as defined herein, is added on top of a wash liquor formed by dissolution or dispersion of a typical laundry detergent. It is also essential in both cases, that the fabrics be rinsed after they have been contacted with said composition, before said composition has completely dried off.

By "treating" it is meant herein, cleaning, as the composition according to the present invention provides excellent stain removal performance on a broad range of stains and soils and on various surfaces due mainly to the presence of the surfactant system herein, as well as bleaching, as the composition according to the present invention provides excellent bleach performance due mainly to the presence of the peroxygen bleach and the surfactant system herein.

By "washing", it is to be understood herein that the fabrics are contacted with a conventional detergent composition comprising at least one surface active agent in an aqueous bath, this washing may occur by means of a washing machine or simply by hands.

By "in its neat form", it is to be understood that the liquid compositions are applied directly onto the fabrics to be pretreated without undergoing any dilution, i.e. the liquid compositions herein are applied onto the fabrics as described herein.

Indeed, it has been found that water evaporation contributes to increase the concentration of free radicals onto the surface of the fabrics and, consequently, the rate of chain reaction. It is also speculated that an auto-oxidation reaction occurs upon evaporation of water when the liquid compositions are left to dry onto the fabrics. Said reaction of auto-oxidation generates peroxy-radicals which may contribute to the degradation of cellulose. Thus, not leaving the liquid compositions, as described herein, to dry onto the fabric, in a process of pretreating soiled fabrics, contributes to reduce the tensile strength loss and/or color damage when pretreating fabrics with liquid peroxygen bleach-containing compositions.

In the pretreatment mode, the process comprises the steps of applying said liquid composition in its neat form onto said fabrics, or at least soiled portions thereof, and subsequently rinsing, or washing then rinsing said fabrics. In this mode, the neat compositions can optionally be left to act onto said fabrics for a period of time ranging from 1 min. to 1 hour, before the fabrics are rinsed, or washed then rinsed, provided that the composition is not left to dry onto said fabrics. For particularly though stains, it may be appropriate to further rub or brush said fabrics by means of a sponge or a brush, or by rubbing two pieces of fabrics against each other.

In another mode, generally referred to as "soaking", the process comprises the steps of diluting said liquid composition in its neat form in an aqueous bath so as to form a diluted composition. The dilution level of the liquid composition in an aqueous bath is typically up to 1:85, preferably up to 1:50 and more preferably about 1:25 (composition:water). The fabrics are then contacted with the aqueous bath comprising the liquid composition, and the fabrics are finally rinsed, or washed then rinsed. Preferably in that embodiment, the fabrics are immersed in the aqueous bath comprising the liquid composition, and also preferably, the fabrics are left to soak therein for a period of time ranging from 1 minute to 48 hours, preferably from 1 hour to 24 hours.

In yet another mode which can be considered as a sub-embodiment of "soaking", generally referred to as "bleaching through the wash", the liquid composition is used as a so-called laundry additive. And in that embodiment the aqueous bath is formed by dissolving or dispersing a conventional laundry detergent in water. The liquid composition in its neat form is contacted with the aqueous bath, and the fabrics are then contacted with the aqueous bath containing the liquid composition. Finally, the fabrics are rinsed.

In another embodiment the present invention also encompasses a process of treating a hard-surface, as the inanimate surface. In such a process a composition, as defined herein, is contacted with the hard-surfaces to be treated. Thus, the present invention also encompasses a process of treating a hard-surface with a composition, as defined herein, wherein said process comprises the step of applying said composition to said hard-surface, preferably only soiled portions thereof, and optionally rinsing said hard-surface.

In the process of treating hard-surfaces according to the present invention the composition, as defined herein, may be applied to the surface to be treated in its neat form or in its diluted form typically up to 200 times their weight of water, preferably into 80 to 2 times their weight of water, and more preferably 60 to 2 times.

When used as hard surfaces cleaners the compositions of the present invention are easy to rinse and provide good shine characteristics on the treated surfaces.

Depending on the end-use envisioned, the compositions herein can be packaged in a variety of containers including conventional bottles, bottles equipped with roll-on, sponge, brusher or sprayers.

The invention is further illustrated by the following examples.

EXAMPLES

Following compositions were made by mixing the listed ingredients in the listed proportions (weight % unless otherwise specified).

| Compositions | I | II | III | IV | V | VI | VII | VIII |
|---|---|---|---|---|---|---|---|---|
| Dobanol ® 23-3 | 1.0 | 2.0 | 1.0 | 2.0 | 2.0 | 1.0 | 2.0 | 1.0 |
| Dobanol ® 45-7 | 3.0 | 1.5 | 3.0 | 1.5 | — | 3.0 | 1.5 | 3.0 |
| Dobanol ® | — | — | — | — | 1.0 | — | — | — |

-continued

| | | | | | | | | |
|---|---|---|---|---|---|---|---|---|
| 91-8 | | | | | | | | |
| Dobanol ® 91-10 | — | — | — | — | 1.0 | — | — | — |
| Salt-free Betaine* | 2.0 | 2.5 | 2.0 | 2.5 | 1.0 | — | — | — |
| Alkylbetaine | — | — | — | — | — | 2.5 | 2.5 | 2.0 |
| $H_2O_2$ | 7.0 | 7.0 | 8.0 | 9.0 | 7.0 | 7.0 | 8.0 | 6.0 |
| Ethydronic Acid | 0.16 | 0.16 | 0.16 | 0.16 | 0.16 | 0.16 | 0.16 | 0.16 |
| Silicon | 0.01 | 0.01 | 0.01 | 0.01 | 0.01 | 0.01 | 0.01 | 0.01 |
| Capped alcohol | 0.1 | 0.1 | 0.1 | 0.1 | 0.1 | 0.1 | 0.1 | 0.1 |
| Xylene-sulphonic acid | 0.8 | 1.0 | 0.8 | 1.0 | — | 1.5 | 1.0 | 0.5 |
| p-Toluene Sulphonate | — | — | — | — | 1.0 | — | — | 0.5 |
| BHT | 0.1 | 0.1 | 0.1 | 0.1 | 0.1 | 0.1 | 0.1 | 0.1 |
| Water and minors | up to 100% | | | | | | | |
| All examples have a pH under 9 | | | | | | | | |

| Compositions | IX | X | XI | XII |
|---|---|---|---|---|
| Dobanol ® 23-3 | 1.0 | 1.0 | 1.0 | 1.0 |
| Dobanol ® 45-7 | 3.0 | 3.0 | 3.0 | 3.0 |
| Salt-free Betaine* | 2.0 | 2.5 | 2.0 | 2.0 |
| $H_2O_2$ | 6.8 | 6.8 | 6.8 | 7.5 |
| Ethydronic Acid | 0.16 | 0.16 | 0.16 | 0.16 |
| Silicon | 0.01 | 0.01 | 0.01 | 0.01 |
| Capped alcohol | 0.1 | 0.1 | 0.1 | 0.1 |
| Coconut-fatty acid | 0.1 | 0.1 | 0.1 | 0.1 |
| Xylenesulphonic acid | 0.2 | 0.2 | 0.2 | 0.2 |
| BHT | 0.1 | 0.1 | 0.1 | 0.1 |
| Citric acid | 0.5 | 0.5 | 0.5 | 0.5 |
| Water and minors | up to 100% | | | |
| All examples have a pH under 9 | | | | |

Dobanol® 23-3 is a C12–C13 EO3 nonionic surfactant commercially available from SHELL.

Dobanol® 45-7 is a C14–C15 EO7 nonionic surfactant commercially available from SHELL.

Dobanol® 91-8 is a C9–C11 EO8 nonionic surfactant commercially available from SHELL.

Dobanol® 91-10 is a C9–C11 EO10 nonionic surfactant commercially available from SHELL.

BHT is di-tert-butyl hydroxy toluene.

Salt-free Betaine* is Lauryl di-methyl betaine containing 0.3% by weight of sodium chloride, This betaine is obtainable by purification from commercially available Lauryl di-methyl betaine GENAGEN. LAB® (Hoechst) (which contains 7.5% of sodium chloride).

Alkyl betaine is Lauryl di-methyl betaine commercially available by Hoechst under the trade name GENAGEN. LAB®

Capped Alcohol is PLURAFAC LF231® by BASF

Coconut-fatty acid is commercially available from UNICHEMA under the name PRIFAC 5900®

All the stated examples herein are physically stable, i.e., they resist more than 1 month at 0° C. without showing phase separation or noticeable haziness.

All the above compositions show good stain removal and bleaching performance. Surprisingly the compositions comprising salt free zwitterionic betaine surfactants (Examples I to V and IX to XII) deliver improved safety to fabrics and/or colors.

What is claimed is:

1. A liquid bleach composition consisting of:

A.) from 1.5% to 10%, by weight, of said composition of hydrogen peroxide;

B.) a surfactant component consisting of from 3% to 60%, by weight, of said composition of an ethoxylated nonionic surfactant and from 0.5% to 5%, by weight, of said composition of a salt-free betaine surfactant; and C.) from 0.1% to 5%, by weight, of said composition of a sulphonated hydrotrope, at a weight ratio of betaine surfactant: hydrotrope in the range of 1:1 to 10:1.

2. A method of bleaching fabrics to remove stains, comprising the step of contacting said fabrics with the composition of claim 1.

* * * * *

UNITED STATES PATENT AND TRADEMARK OFFICE

CERTIFICATE OF CORRECTION

PATENT NO. : 6,482,786 B1
DATED : November 19, 2002
INVENTOR(S) : Valerio et al.

It is certified that error appears in the above-identified patent and that said Letters Patent is hereby corrected as shown below:

Title page,
Item [22], PCT Filed, "May 7, 1999" should read -- May 21, 1999 --.

Signed and Sealed this

Nineteenth Day of August, 2003

JAMES E. ROGAN
*Director of the United States Patent and Trademark Office*